US011834882B2

(12) United States Patent
Eccleston

(10) Patent No.: US 11,834,882 B2
(45) Date of Patent: Dec. 5, 2023

(54) PANEL SWIVEL SYSTEMS AND METHODS RELATING THERETO

(71) Applicant: Jon Erwin Eccleston, Oakland, CA (US)

(72) Inventor: Jon Erwin Eccleston, Oakland, CA (US)

(73) Assignee: Jon Erwin Eccleston, Oakland, CA (US)

( * ) Notice: Subject to any disclaimer, the term of this patent is extended or adjusted under 35 U.S.C. 154(b) by 371 days.

(21) Appl. No.: 17/156,644

(22) Filed: Jan. 25, 2021

(65) Prior Publication Data

US 2021/0230919 A1 Jul. 29, 2021

Related U.S. Application Data

(60) Provisional application No. 62/964,661, filed on Jan. 23, 2020.

(51) Int. Cl.
*E05D 7/081* (2006.01)
*E05D 5/14* (2006.01)
*E05D 5/02* (2006.01)

(52) U.S. Cl.
CPC ..... *E05D 7/081* (2013.01); *E05D 5/02* (2013.01); *E05D 5/14* (2013.01); *E05Y 2900/132* (2013.01)

(58) Field of Classification Search
CPC ..... E05D 7/08; E05D 7/081; E05D 7/082; E05D 7/083; E05D 7/084; E05D 7/085; E05D 5/14; E05D 5/02; E05D 5/0215; E05D 5/0223; E05D 5/023; E05D 5/0238; E05D 5/06; E05D 5/065
USPC ..... 16/378, 379
See application file for complete search history.

(56) References Cited

U.S. PATENT DOCUMENTS 1,518,220 A * 12/1924 Petrie ..... F16C 33/103 16/273
2,554,540 A * 5/1951 Polson ..... E05D 15/54 16/292
3,030,655 A * 4/1962 Rudnick ..... E05D 7/0027 16/243
3,141,190 A * 7/1964 Reiss ..... E05D 7/081 16/259

(Continued)

*Primary Examiner* — Jeffrey O'Brien
(74) *Attorney, Agent, or Firm* — EcoTech Law Group, P.C.

(57) ABSTRACT

Systems and methods for swiveling a panel in relation to a panel frame are described. An exemplar panel swivel system includes a swivel support member, a housing subassembly, and a shaft. The swivel support member includes a base portion that has a first terminating end, a second terminating end, and has defined therein a shaft receiving aperture. The swivel support member further includes a raised surface extending from the first terminating end of the base portion and is designed to contact a top support structure and a securing edge extending from the second terminating end of that base portion, which is designed to contact a side support structure. The housing subassembly extends an elevated distance above the base portion. A central aperture defined in the housing subassembly aligned with the shaft receiving aperture. The shaft extends a shaft length and at least some of the shaft passes through the central aperture and the shaft receiving aperture. The shaft terminates at a panel fitting end that is designed to engage with a panel.

13 Claims, 6 Drawing Sheets

(56) References Cited

U.S. PATENT DOCUMENTS

| | | | | |
|---|---|---|---|---|
| 3,222,711 | A * | 12/1965 | Cecala | E05D 7/081 16/272 |
| 6,070,300 | A * | 6/2000 | Shin | E05D 7/1044 16/382 |
| 6,408,484 | B1 * | 6/2002 | Vandertouw | E05D 11/1078 16/374 |
| 7,305,796 | B2 * | 12/2007 | Chiang | E05F 1/1253 16/255 |
| 8,495,795 | B2 * | 7/2013 | Christie | E05D 11/1078 16/315 |
| 8,984,717 | B1 * | 3/2015 | Jackson | E05F 1/1253 16/273 |
| 10,316,561 | B2 * | 6/2019 | Barker | E05D 7/1022 |
| 2005/0086885 | A1 * | 4/2005 | Kao | E05D 5/0246 52/506.01 |
| 2022/0042361 | A1 * | 2/2022 | Jadhav | E05D 3/02 |
| 2022/0127888 | A1 * | 4/2022 | Gardner | E05F 1/1269 |
| 2022/0282539 | A1 * | 9/2022 | Li | E05D 3/18 |
| 2022/0412139 | A1 * | 12/2022 | Xia | E05D 15/56 |

* cited by examiner

PANEL SWIVEL SYSTEMS AND METHODS RELATING THERETO

RELATED APPLICATION

This application claims priority to U.S. Provisional Application having Ser. No. 62/964,661 filed on Jan. 23, 2020, which is incorporated by reference for all purposes.

FIELD

The present teachings generally relate to coupling mechanism systems and methods related thereto that that couple panels (e.g., different types of doors) to panel frames (e.g., to door frames). More particularly, the present teachings relate to novel panel swivel systems (e.g., door opening or closing systems) and processes relating thereto.

BACKGROUND

Panel swivel systems couple panels to panel frames and facilitate opening and closing panels with respect to panel frames. Conventional panel swivel systems, however, are structurally complex, which increase production costs, weight, and maintenance of the coupling mechanism.

What is needed, therefore, are simplified, inexpensive, and easy-to-manufacture designs of panel swivel systems and methods.

SUMMARY

To this end, the present systems and methods provide improved panel swivel systems and methods related thereto. The present panel swivel systems, among other things, effectively and simply couple a panel to a panel frame and allow at least a portion of the panel to swivel or rotate towards or away from the panel frame.

In one aspect, the present arrangements provide a panel swivel that includes a swivel support member, a housing subassembly, and a shaft. The swivel support member has a base portion, which includes a first terminating end and a second terminating end. A shaft receiving aperture is defined within and extends through the base portion. Additionally, a raised surface extends from the first terminating end of the base portion and is designed to contact a top support structure such as a panel frame or door frame. The raised surface has defined therein raised surface apertures that allow fasteners to pass through the raised surface and the top support structure such that the raised surface attaches to the top support structure.

A securing edge extends from the second terminating end of the base portion and is designed to contact a side support structure. One or more securing apertures are defined within and extend through the securing edge. The securing apertures allow securing edge fasteners to pass through the securing edge and the side support structure such that the securing edge attaches to the side support structure.

The housing subassembly, in a preferred implementation of the present arrangements, extends an elevated distance above the base portion and is located at an extending distance away from the raised surface apertures. In particular, the housing subassembly is disposed on an area extending between the raised surface and the securing edge, and the area extending between the raised surface and the securing edge is not enclosed. Moreover, the area does not include any structure disposed thereon except the housing subassembly.

The extending distance is a distance between a center point of the raised surface apertures and a center point of the central aperture. In a preferred implementation of the present arrangement, the elevated distance ranges between about 0.1 inches and about 1.5 inches, and the extending distance ranges between about 2 inches and about 2.5 inches. Moreover, the housing subassembly has defined therein a central aperture that aligns with the shaft receiving aperture.

The shaft, in a preferred implementation of the present arrangements, extends a shaft length and at least some of the shaft length passes through the central aperture and the shaft receiving aperture. The shaft terminates at a panel fitting end that is designed to engage, in a swiveling manner, with a panel such that the panel fitting end swivels with respect to the panel or the panel swivels with respect to the panel fitting end. In one embodiment of the present arrangements, the shaft length is a length that ranges between about 1.25 inches and about 3 inches.

In one embodiment of the present arrangements, the raised surface has defined therein a first raised surface aperture and a second raised surface aperture and a distance between a center point of the first raised surface aperture and a center point of the second raised surface aperture ranges between about 1.5 inches and about 1.8 inches. The raised surface, in one embodiment of the present arrangements, extends a raising distance above the base portion. Preferably, the raising distance ranges between about 0.06 inches and about 2 inches.

The securing edge has defined therein a first securing edge aperture and a second securing edge aperture and a distance between a center point of the first securing edge aperture and a center point of the second securing edge aperture ranges between about 1.5 inches and about 1.8 inches.

The panel swivel, one implementation of the present arrangements, further includes one or more bearings disposed within the housing subassembly. At least a portion of each of the bearings is aligned with the central aperture and engages the portion of the shaft that passes through the central aperture. In another implementation of the present arrangements, however, the housing subassembly is one or more bearings. In other words, one or more bearings replace the housing subassembly. Preferably, at least a portion of each of the bearings is aligned with the central aperture and engages the portion of the shaft that passes through the central aperture.

Preferably, one or more of the bearings is one or more sleeve bearings. Each sleeve bearing includes inner sidewalls that substantially circumferentially extend to define the central aperture. An outside diameter of the shaft contacts the inner diameter of the sleeve bearings.

The housing subassembly, in one implementation of the present arrangements, includes a housing cap which as defined therein one or more securing apertures. Each securing aperture is designed to allow securing fasteners to pass through the housing cap and the base portion to facilitate coupling of housing subassembly with the base portion. Preferably, the base portion includes one or more fastener receivers, each of which is aligned with the securing apertures of the housing cap and designed to receive securing fasteners.

The shaft, in one embodiment of the present arrangements, includes one or more securing rings (whereinafter also referred to as "o-rings"), each of which is disposed within an o-ring groove that is defined around a circumference of the shaft. When at least a portion of the shaft passes through the shaft receiving aperture, one or more of the o-rings contacts the shaft receiving aperture.

The swivel support member and/or housing subassembly is made of at least one material selected from a group comprising sheet metal, plastic, wood, bamboo, fiberboard, and fiberglass.

In another aspect, the present teachings provide methods of assembling a panel swivel. An exemplar method of assembling a panel swivel includes: (a) obtaining a swivel support member that includes: (i) a base portion including a first terminating end, a second terminating end and having defined therein a shaft receiving aperture; (ii) a raised surface extending from the first terminating end of the base portion and designed to contact a top support structure; and (iii) a securing edge extending from the second terminating end of the base portion and designed to contact a side support structure; (b) securing a housing subassembly, having defined therein a central aperture, on the swivel support member such that the housing subassembly is disposed on an area of the base portion that extends between the raised surface and the securing edge, and the central aperture aligns with the shaft receiving aperture; (c) engaging at least a portion of a shaft through the central aperture and the shaft receiving aperture; and (d) adjusting a position of the shaft along a collective length spanned by the central aperture and the shaft receiving aperture so that the shaft terminates at a panel fitting end that engages, in a swiveling manner, with a panel and the panel fitting end swivels with respect to the panel or the panel swivels with respect to the panel fitting end.

In the method above, the securing step may further include: (a) positioning one or more bearings between the base portion and a housing cap, having defined therein securing apertures, such that at least a portion of each of the bearings is aligned with the central aperture and is designed to engage a portion of the shaft that passes through the central aperture; and (b) coupling the housing cap with the base portion by passing securing fasteners through securing apertures and securing the securing fasteners to one or more fastener receivers on the base portion. Each of the fastener receivers is aligned with the securing apertures of the housing cap and designed to receive securing fasteners.

In one embodiment of the present teachings, the method of assembling a panel swivel further comprising securing one or more o-rings to the shaft, each of which is disposed within an o-ring groove that is defined around a circumference of the shaft.

The system and method of assembly of the present teachings and arrangements, however, together with the additional objects and advantages thereof, will be best understood from the following descriptions of specific embodiments when read in connection with the accompanying figures.

DETAILED DESCRIPTION OF THE PREFERRED EMBODIMENTS

In the following description, numerous specific details are set forth in order to provide a thorough understanding of the present teachings and arrangements. It will be apparent, however, to one skilled in the art that the present teachings and arrangements may be practiced without limitation to some or all of these specific details. In other instances, well-known process steps have not been described in detail in order to not unnecessarily obscure the present teachings and arrangements.

The present teachings recognize that commercial, residential, and industrial panels use various coupling mechanisms, for example, conventional panel swivels, to couple panels (e.g., different types of doors) to panel frames (e.g., to door frames) that facilitate opening and closing panels with respect to panel frames. However, these coupling mechanisms include components and features that are not necessary or do not participate in the coupling mechanisms' assembly and/or function with respect to panels and panel frames. Specifically, conventional coupling mechanisms have components and features that do not contribute during panel assembly, installation or panel movement and significantly increase the cost, weight, and maintenance of the coupling mechanism.

Realizing such drawbacks of conventional panel swivel systems and related processes, the present teachings and arrangements propose improved coupling mechanisms that represent a simplified design.

Figure 1:
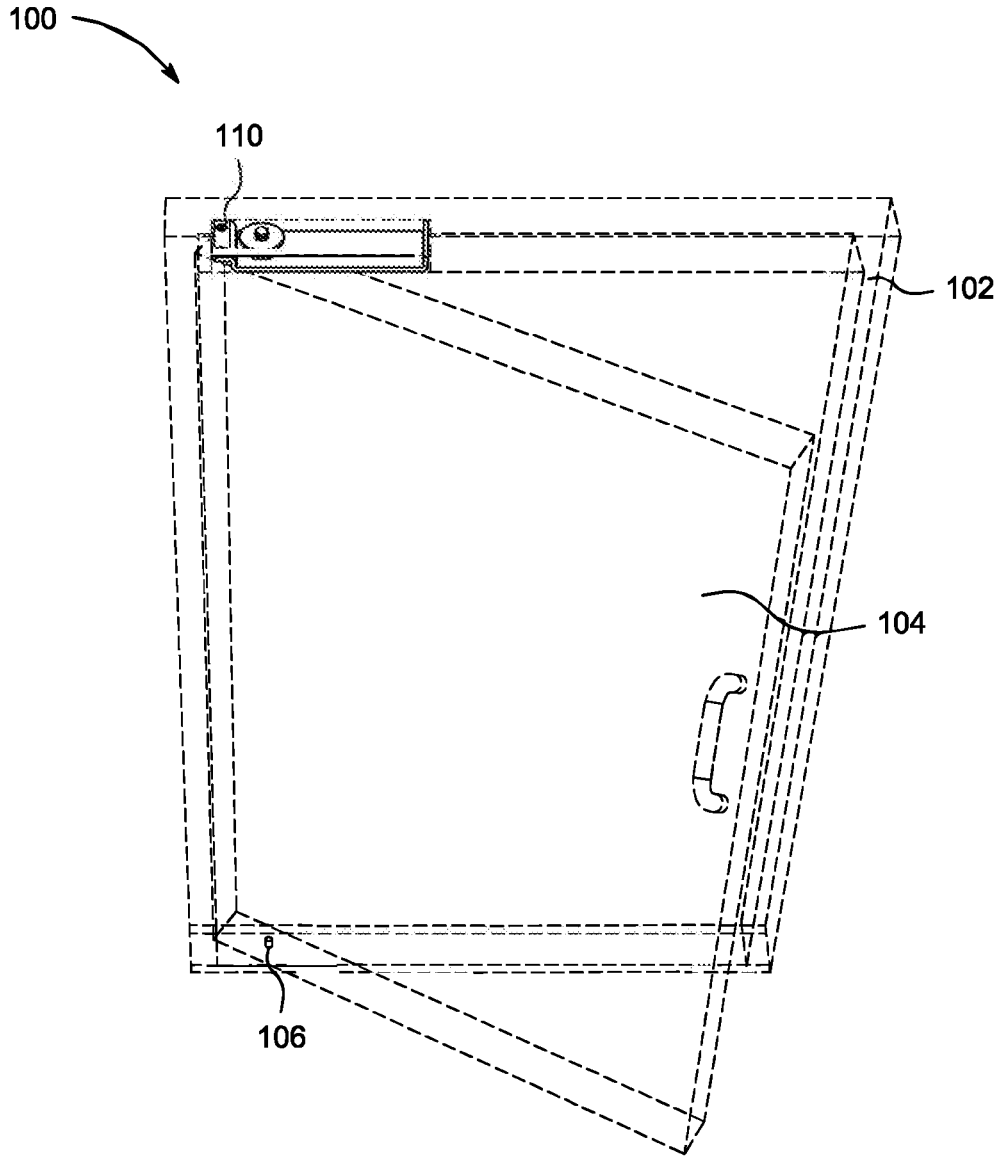
FIG. 1 shows a perspective view of an entryway, according to one embodiment of the present arrangements, and that includes a panel swivel that couples a panel frame to a panel.

FIG. 1 shows a novel panel swivel 110, according to one embodiment of the present arrangements, that couples a panel frame 102 to a panel 104. Further, panel frame 102 surrounds a boundary of an entryway 100. Fitted onto panel frame 102 are panel swivel 110 and a pivot hinge 106 that, in combination with panel swivel 110, allows portions of panel 104 that are positioned away from panel swivel 110, to swivel or rotate in a direction towards or away from panel frame 102. In other words, panel 104 rotates about an axis of rotation that extends through panel swivel 110 and pivot hinge 106 to at least partially open or close entryway 100. Indeed, in preferred embodiments of the present arrangement, panel 104 rotates about this axis of rotation to completely close entryway 100.

In preferred embodiments of the present arrangements, panel swivel 110 is positioned in a recess or cavity defined within panel frame 102 to obscure panel swivel 110 from view. In typical preferred embodiments of the present arrangements, the recess or cavity is defined at a top portion of panel frame 102 that is proximate to a location where panel 104 couples with panel frame 102. Thus, panel swivel 110 does not disturb an aesthetic appearance of the panel 104 and/or panel frame 102.

Figure 2:
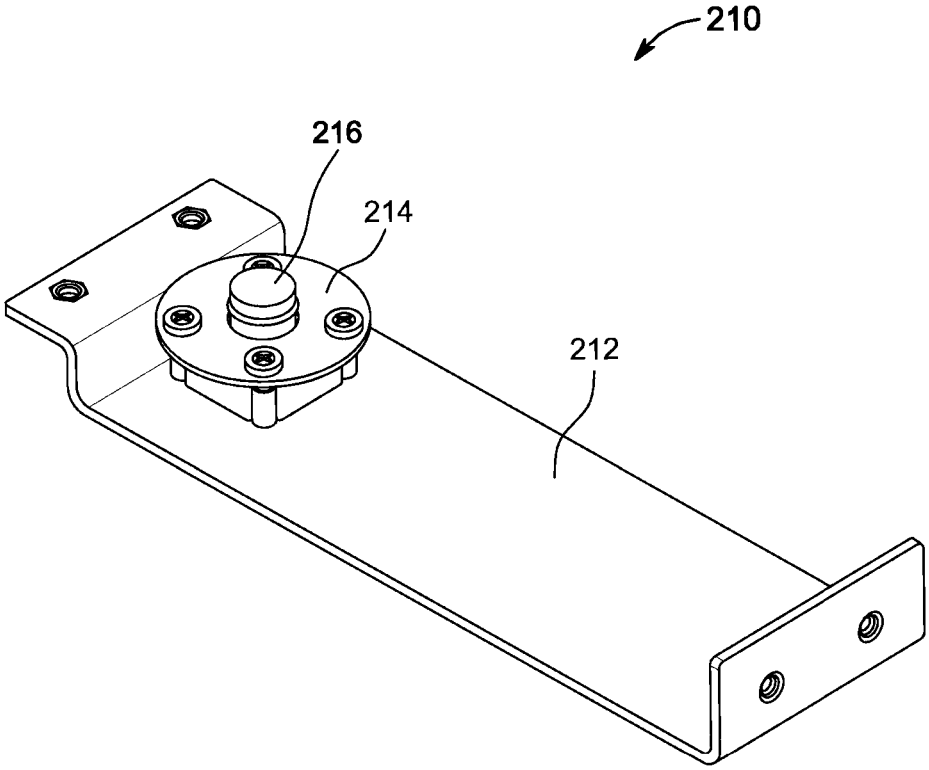
FIG. 2 shows a perspective view of the panel swivel of FIG. 1, which includes a swivel support member, a housing subassembly, and a shaft.

FIG. 2 shows, in greater detail, a panel swivel 210, according to one embodiment of the present arrangements, and that is substantially similar to panel swivel 110 of FIG. 1. Panel swivel 210 includes a swivel support member 212, a housing subassembly 214, and a shaft 216. Housing subassembly 214 extends above swivel support member 212 and houses at least a portion of shaft 216.

Figure 3:
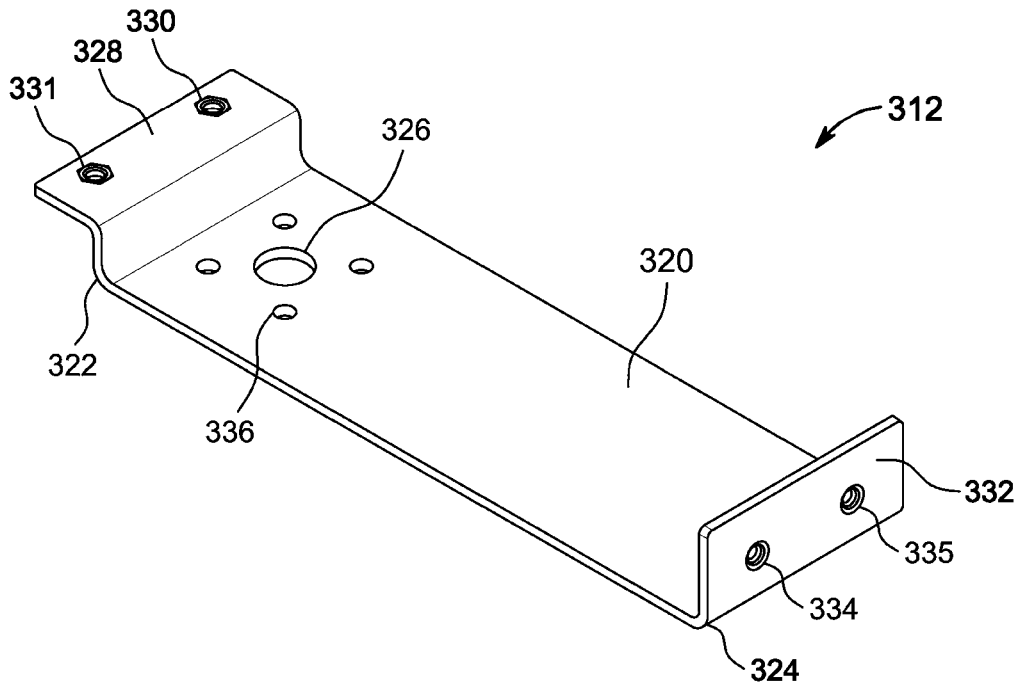
FIG. 3 shows a perspective view of the swivel support member of FIG. 2.

FIG. 3 shows a swivel support member 312, according to one embodiment of the present arrangements, that is substantially similar to swivel support member 212 of FIG. 2. Swivel support member 312 includes a base portion 320 having a first terminating end 322 and a second terminating end 324. Between first terminating end 322 and second terminating end 324, base portion 320 has defined therethrough a shaft receiving aperture 326 and one or more fastener receivers 336. As will be discussed in greater detail below, shaft receiving aperture 326 receives at least a portion of a shaft (e.g., shaft 216 of FIG. 2) and one or more fastener receivers 336 may receive at least a portion of a securing fastener (e.g., securing fastener 447 of FIG. 4).

A raised surface 328 extends from first terminating end 322 of base portion 320 and has defined therein one or more raised surface apertures (e.g., a first raised surface aperture 330 and a second raised surface aperture 331). When swivel support member 312 is installed within a panel frame (e.g., panel frame 102 of FIG. 1), raised surface 328 is designed to contact a top support structure (e.g., a top support structure of panel frame 102 of FIG. 1). One or more fasteners, each disposed through each raised surface aperture, effectively secure raised surface 328 to the top support structure.

In a preferred embodiment of the present arrangements, raised surface 328 is substantially parallel to base portion 320 but extends a raising distance from base portion 320, which is measured from a bottom surface of base portion 320 to a bottom surface of raised surface 328. The raising distance above base portion 320 ranges between about 0.06 inches and about 2 inches. In a preferred embodiment of the present arrangements, the raising distance ranges between about 0.5 inches and about 1 inch. In a more preferred embodiment of the present arrangements, the raising distance ranges between about 0.7 inches and about 0.8 inches. In one embodiment of the present arrangements, the raising distance is about 0.76 inches.

In another embodiment of the present arrangements, raised surface 328 has defined therein a first raised surface aperture 330 and a second raised surface aperture 331. In these embodiments, a distance between a center point of first raised surface aperture 330 and a center point of second raised surface aperture 331 ranges between about 1.9 inches and about 2.1 inches. In a preferred embodiment of the present arrangements, the distance between a center point of first raised surface aperture 330 and a center point of second raised surface aperture 331 ranges between about 1.95 inches and about 2.05 inches. In a more preferred embodiment of the present arrangements, the distance between a center point of first raised surface aperture 330 and a center point of second raised surface aperture 331 ranges between about 1.97 inches and about 2.01 inches. In one embodiment of the present arrangements, the distance between a center point of first raised surface aperture 330 and a center point of second raised surface aperture 331 is about 1.99 inches.

A securing edge 332 extends from second terminating end 324 and away from base portion 320 and has defined therein one or more securing edge apertures (e.g., first securing edge aperture 334 and a second securing edge aperture 335). Preferably, however, securing edge 332 extends away from base portion 320 in the same direction as raised surface 328 extends away from base portion 320. In a preferred embodiment of the present arrangements, securing edge 332 is substantially perpendicular to base portion 320. When swivel support member 312 is installed to the panel frame, securing edge 332 is designed to contact a side support structure (e.g., a side support structure of panel frame 102 of FIG. 1 or a side support structure that is located at a top portion of a door frame). In this installed configuration of securing edge 332, each of one or more fasteners are disposed through a securing edge aperture to fasten securing edge 332 to the side support structure.

In one embodiment of the present arrangements, securing edge 332 includes a first securing edge aperture 334 and a second securing edge aperture 335 and a distance between a center point of first securing edge aperture 334 and a center point of second securing edge aperture 335 ranges between about 1.5 inches and about 1.8 inches. In a preferred embodiment of the present arrangements, the distance between the center point of first securing edge aperture 334 and the center point of second securing edge aperture 335 ranges between about 1.55 inches and about 1.7 inches. In a more preferred embodiment of the present arrangements, the distance between the center point of first securing edge aperture 334 and the center point of second securing edge aperture 335 ranges between about 1.6 inches and about 1.66 inches. In one embodiment of the present arrangements, the distance between the center point of first securing edge aperture 334 and the center point of second securing edge aperture 335 is about 1.64 inches.

Swivel support member 312, in one implementation of the present arrangements, has a uniform thickness that ranges between about 0.02 inches and about 1.5 inches. In a preferred embodiment of the present arrangements, swivel support member 312 has a uniform thickness that ranges between about 0.06 inches and about 0.5 inches. In a more preferred embodiment of the present arrangements, swivel support member 312 has a uniform thickness that ranges between about 0.1 inches and about 0.2 inches. In one embodiment of the present arrangements, swivel support member 312 has a uniform thickness of about 0.125 inches.

The present arrangements of swivel support member 312, however, are not limited to a uniform thickness. Rather, the thickness of swivel support member 312 may change for structural, aesthetic, and ease of manufacturing or assembly reasons. By way of example, raised surface 328 and securing edge 332 may be thicker than base portion 320 to withstand compressive pressures when fasteners secure swivel support member 312 to a panel frame.

As discussed above, the present arrangements reduce manufacturing costs and take less time to manufacture and assemble. By way of example, unlike conventional panel swivels, an area of base portion 320, extending between raised surface 328 and securing edge 332, is not enclosed. Although swivel support member 312 may reside inside a panel frame (e.g., panel frame 102 of FIG. 1), swivel support member 312 need not, in preferred embodiments of the present arrangements, include additional features, such as extending sidewalls and top surface to serve an enclosing function. This is important because, in implementing conventional designs of panel swivel systems, sidewalls and top surfaces extend from certain components of the conventional panel swivel systems to form an enclosure of sorts that ultimately resides within the panel frame. In other words, in conventional designs of panel swivel systems, these extending sidewalls and top surface are in addition to the enclosure function provided by the panel frame.

The present arrangements, among other advantages, realizes that such extending sidewalls and tops surface found in the conventional designs are not necessary. As a result, features such as raised surface 328 and securing edge 332 need not include extending sidewalls or an enclosing top surface that, together, would form an additional enclosure for the entire swivel support member 312. An absence of such an additional enclosure that is found in conventional designs significantly reduces, materials need to manufacture swivel support member 312, which reduces weight, manufacturing costs, and material costs for the present arrangements.

Moreover, the present arrangements provide embodiments that, in addition to significantly reducing cost and weight, also reduces design complexity. In preferred assembled configurations of the present panel swivels, only a housing subassembly and a shaft (e.g., housing subassembly 214 and shaft 216 of FIG. 2) are disposed atop and/or through base portion 320. No other component or structure need be disposed on the other areas of base portion 320 extending between raised surface 328 and securing edge 332.

Figure 4:
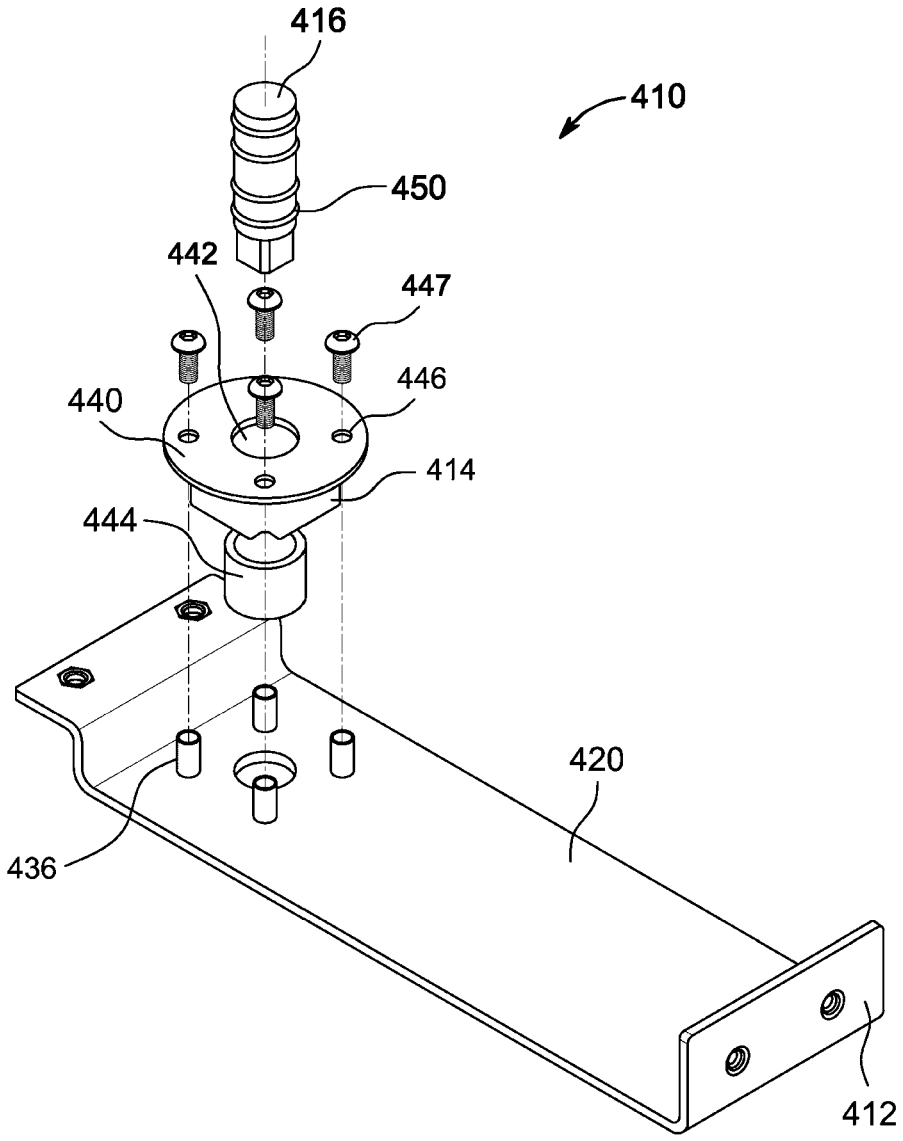
FIG. 4 shows an exploded view of the panel swivel of FIG. 1.

FIG. 4 shows a panel swivel 410, according to one embodiment of the present arrangements, and that is substantially similar to panel swivel 210 of FIG. 2. Panel swivel 410 includes a swivel support member 412, a housing subassembly 414, and a shaft 416, which are substantially similar to their counterparts in FIG. 2 (i.e., swivel support member 212, housing subassembly 214, and shaft 216, respectively).

Shaft 416 includes one or more securing ring grooves (not shown for ease of illustration) defined around a circumference of shaft 416. A securing ring 450 is disposed in each of the securing grooves. Shaft 416 further includes a panel fitting end 452 that is designed to engage, in a swiveling manner, with a panel (e.g., panel 104 of FIG. 1).

Housing subassembly 414, which includes a housing cap 440 and one or more bearings (e.g., a sleeve bearing 444), extends from a base portion 420 of swivel support member 412 and has defined therein a central aperture 442 that is aligned with a shaft receiving aperture (e.g., shaft receiving aperture 326 of FIG. 3) of the swivel support member 412. Housing subassembly 414 extends from base portion 420 in a similar direction as a raised surface (e.g., raised surface 328 of FIG. 3) and a securing edge (e.g., securing edge 332 of FIG. 3) of swivel support member 412.

At least a portion of each of the bearings is aligned with central aperture 442 and is designed to engage with at least a portion of shaft 416 and/or securing rings 450. In a preferred embodiment of the present arrangements, one or more of the bearings is one or more sleeve bearings and more preferably a single sleeve bearing 444. Referring to FIG. 4, sleeve bearing 444 is disposed inside housing subassembly 414 and includes an inner diameter and an outer diameter. The inner diameter provides a sidewall that substantially circumferentially extends to define central aperture 442.

Housing cap 440 inhibits translational displacement of sleeve bearing 444. Housing cap 440 sandwiches sleeve bearing 444 between housing cap 440 and base portion 420. Housing cap 440 includes a central housing cap aperture that aligns with central aperture 442 and one or more securing apertures 446. To effectively secure housing subassembly 414 to base portion 420, one or more securing fasteners 447, each disposed through securing aperture 446, is secured to one or more fastener receivers 436, located on base portion 420.

When one or more of the bearings is engaged with shaft 416 and/or securing rings 450, one or more of the bearings reduces rotational resistance between shaft 416 and housing subassembly 414 and/or ultimately between shaft 416 and swivel support member 412. However, the engagement between one or more of the bearings and shaft 416 and/or securing rings 450 provides translational resistance that preferably keeps shaft 416 prevents shaft 416 from disengaging with one or more of the bearings.

In an assembled configuration, central aperture 442 and the shaft receiving aperture (e.g., shaft receiving aperture 326 of FIG. 3) receive at least a portion of shaft 416 and at least a portion of panel fitting end 452 protrudes beyond base portion 420 such that panel fitting end 452 may couple with a panel. When at least a portion of shaft 416 passes through housing subassembly 414, in one implementation of the present arrangements, shaft 416 contacts the inner sidewall of sleeve bearing 444. As discussed above, sleeve bearing 444 reduces rotational resistance between shaft 416 and sleeve bearing and/or ultimately shaft 416 and swivel support member 412. Moreover, an outer diameter of sleeve bearing 444 may contact housing subassembly 414 to prevent and/or resist translational displacement of sleeve bearing 444 relative to housing subassembly 414.

In another implementation of the present arrangements, shaft 416 does not contact the inner sidewall of sleeve bearing 444. Rather, shaft 416 has an outside diameter that is less than an inner sidewall diameter of sleeve bearing 444. In this configuration, shaft 416 is capable of rotational displacement that is relatively free of resistance between shaft 416 and the inner sidewall of sleeve bearing 444.

In this implementation, shaft 416 further includes two or more securing rings 450, each having an external diameter that is greater than the inner sidewall diameter of sleeve bearing 444. Preferably, a distance between at least two securing rings 450 on shaft 416 is greater than or equal to a length of sleeve bearing 444 (i.e., a length of sleeve bearing 444, between housing cap 440 and base portion 420). When central aperture 442 and the shaft receiving aperture receive at least a portion of shaft 416, a first securing ring is adjacent to a top surface of sleeve bearing 444 and prevents and/or resists translational movement in a first direction. In other words, the first securing ring contacts the top surface of the sleeve bearing 444 and prevents and/or resists movement of shaft 416 in the first direction. A second securing ring is adjacent to a bottom surface of sleeve bearing 444 and prevents and/or resists translational movement in a second direction, which is opposite from the first direction. To this end, the first securing ring and second securing rings engage with and effectively couple shaft 416 to housing subassembly 414. Thus, shaft 416 is set at a predefined shaft position, relative to the housing subassembly, one or more bearings, and/or swivel support member, while allowing rotational displacement of shaft 416.

In a preferred embodiment of the present arrangements, shaft 416 includes three or more securing rings to create at least two predefined shaft positions. A distance between two securing rings 450 forming a first securing ring grouping is greater than or equal to the length of one or more of the bearings. As described above, two securing rings 450 prevent or restrict translational displacement of the shaft in two opposing directions, thus creating a first predefined shaft position. Two securing rings 450 forming a second securing ring grouping is also separated by distance on the shaft that is greater than or equal to the length of one or more of the bearings create a second predefined shaft position.

In a more preferred embodiment of the present arrangements, shaft 416 includes four securing rings 450 to create two predefined shaft positions. Two securing rings 450 used to create the first predefined shaft position are different than two securing rings 450 used to create the second predefined shaft position. A distance between the first securing ring grouping and the second securing ring grouping may be of any value.

However, the present arrangements recognize that the first securing ring grouping and the second securing ring grouping may share a common securing ring 450. By way of example, in the first predefined shaft position securing ring 450 is adjacent to the top surface of sleeve bearing 444 and in the second predefined shaft position the same securing ring is adjacent to the bottom surface of sleeve bearing 444.

As will be described in greater detail below, in an assembled configuration, shaft 416 may be moved in a translational direction to extend panel fitting end 452 away from swivel support member 412. Conversely, shaft 416 may be moved to contract panel fitting end 452 towards swivel support member 412. Thus, panel swivel 410 may be utilized with panel frames and panels of various dimensions and shaft 416 may be adjusted in a translational direction to facilitate coupling of panels to panel frames and opening and closing panels with respect to panel frames. By way of example, as discussed above, shaft 416 may be moved from a first predefined position to a second predefined position or vice versa.

In one embodiment of the present arrangements, a center point of the shaft receiving aperture and a center point of central aperture 442 are located an extending distance from a center point of one or more raised surface apertures (e.g., first raised surface aperture 330 and second raised surface aperture 331 of FIG. 3) that ranges between about 2 inches and about 2.5 inches. In a preferred embodiment of the present arrangements, the extending distance ranges between about 2.2 inches and about 2.3 inches. In a more preferred embodiment of the present arrangements, the extending distance ranges between about 2.23 inches and about 2.27 inches. In one embodiment of the present arrangements, the extending distance is about 2.25 inches.

In one embodiment of the present arrangements, one or more fastener receivers 436 is flush with a top surface of base portion 420 of swivel support member 412. By way of example, one or more fastener receivers 436 are threaded apertures defined within swivel support member that are designed to engage with a threaded portion of a fastener. In another embodiment of the present teachings, however, one or more fastener receivers 436 extend above the top surface of base portion 420. Additionally, each of one or more fastener receivers 436 may be secured to the base portion as part of a manufacturing process (e.g., fastener receivers 436 and base portion 420 are manufactured as one, single component) or after manufacturing and during assembly. By way of example, during a manufacturing process of casting, 3D printing, or injection molding, one or more fastener receivers 436 and base portion 420 are manufactured as a single component. By way of another example, during assembly, one or more fastener receivers 436 may be secured to base portion 420 (e.g., press-fit, threaded, or bolted).

Housing subassembly 414, in one embodiment of the present arrangements, extends an elevated distance from base portion 420, measured from a top surface of a base portion 420 to a top surface of housing subassembly 414, that ranges between about 0.1 inches and about 1.5 inches. In a preferred embodiment of the present arrangements, the elevated distance ranges between 0.5 inches and about 1.45 inch. In a preferred embodiment of the present arrangements, the extending distance ranges between 1.25 inches and about 1.4 inches. In one embodiment of the present arrangements, the elevated distance is about 1.375 inches. In another embodiment of the present arrangements, the elevated distance is about 1.5 inches.

Shaft 416, in one embodiment of the present arrangements, extends a shaft length that ranges between about 1.25 inches and about 3 inches. In a preferred embodiment of the present arrangements, shaft 416 extends a shaft length that ranges between about 2.2 inches and about 2.3 inches. In a more preferred embodiment of the present arrangements, shaft 416 extends a shaft length that ranges between about 2.23 inches and about 2.7 inches. In one embodiment of the present arrangements, the shaft length is about 2.25 inches.

Figure 5:
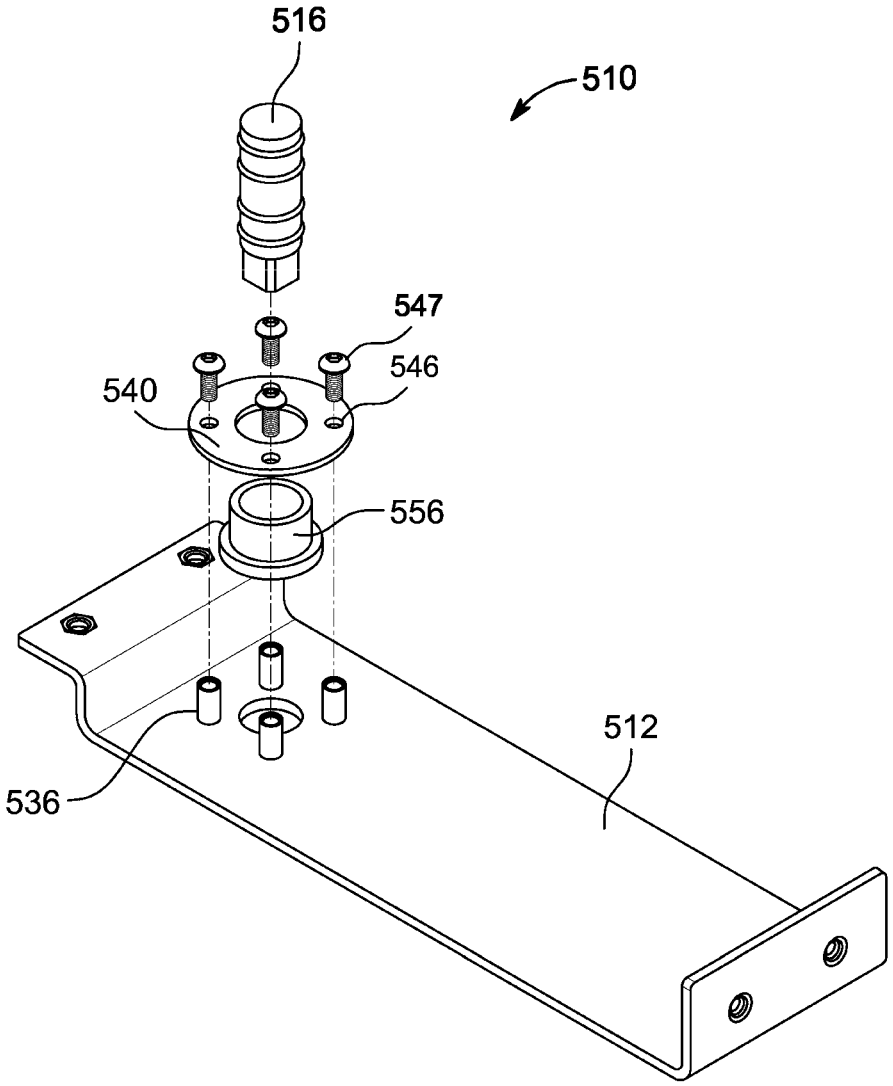
FIG. 5 shows an exploded view of a panel swivel, according to another embedment of the present arrangements, that includes a sleeve bearing instead of a housing subassembly.

FIG. 5 shows an exploded view of a panel swivel 510, according to another embodiment of the present arrangements, wherein instead of a housing subassembly, panel swivel 510 includes a sleeve bearing 556. In this embodiment, sleeve bearing 556 functions in a substantially similar manner as a combined substructure of a bearing disposed within a housing subassembly, which is shown in FIG. 4. Panel swivel 510 includes a swivel support member 512 and a shaft 516, which are substantially similar to swivel support member 412 and a shaft 416 of FIG. 4. An inner sidewall of sleeve bearing 556 is aligned with a receiving aperture (e.g., shaft receiving aperture 326 of FIG. 3) of swivel support member 512. Thus, shaft 504 passes through both sleeve bearing 556 and swivel support member 512.

A housing cap 540, disposed adjacent to sleeve bearing 556, inhibits lateral displacement of sleeve bearing 556. To secure sleeve bearing to a base portion (e.g., base portion 420 of FIG. 4), one or more securing fasteners 547, each disposed through securing aperture 546, is secured to one or more fastener receivers 536, located on base portion 420. Moreover, to restrict translational displacement of sleeve bearing 556, one or more fastener receivers 536 are disposed around a periphery of an outside diameter of sleeve bearing 556 and contact sleeve bearing 556.

Figure 6:
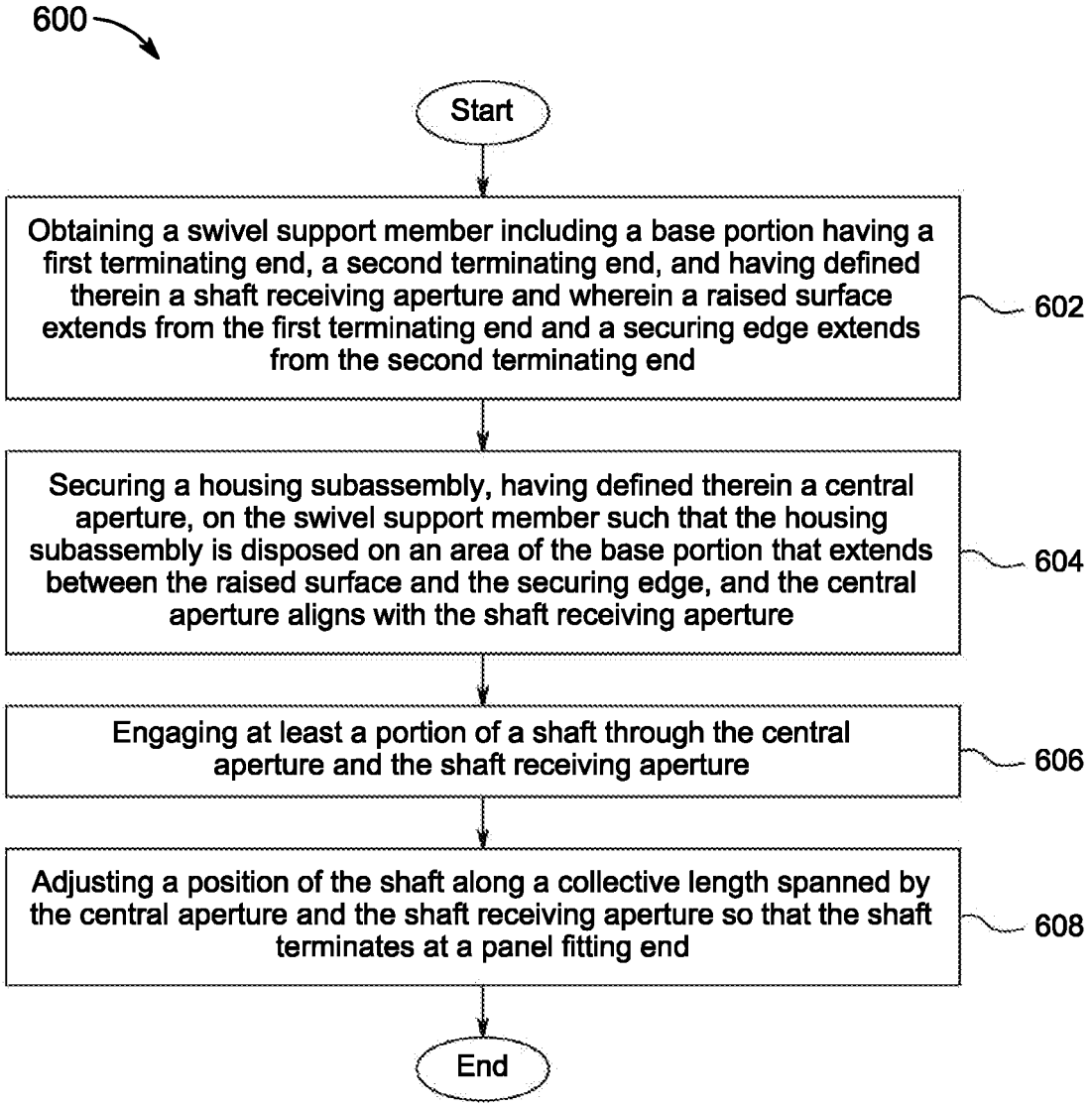
FIG. 6 shows a method, according to one embodiment of the present teachings, of assembling a panel swivel.

The present teachings offer, among other things, different methods of assembling a panel swivel. FIG. 6 shows a method of assembling a panel swivel, according to one embodiment of the present teachings. Method 600 includes a step 602, which includes obtaining a swivel support member (e.g., swivel support member 212 of FIG. 2) that includes a base portion (e.g., base portion 320 of FIG. 3), a raised surface (e.g., raised surface 328 of FIG. 3) and a securing edge (e.g., securing edge 332 of FIG. 3). The base portion includes a shaft receiving aperture, a first terminating end (e.g., first terminating end 322 of FIG. 3), and a second terminating end (e.g., second terminating end 324 of FIG. 3). The raised surface extends from the first terminating end and is designed to contact a top support structure that supports the panel. The securing edge extends from the second terminating end and is designed to contact a side support structure that supports the panel.

The swivel support member, in one embodiment of the present teachings, is made from at least one material selected from a group including sheet metal, plastic, wood, bamboo, fiberboard, and fiberglass.

The swivel support member, in another embodiment of the present teachings, is manufactured from at least one method selected from a group including casting, extruding, molding, stamping, bending, additive manufacturing (e.g., 3-D printing), and milling.

A step 604 includes securing a housing subassembly (e.g., housing subassembly 214 of FIG. 2) to the swivel support member on an area of the base portion that extends between the raised surface and the securing edge. The housing subassembly has defined therein a central aperture (e.g., central aperture 442 of FIG. 4) that aligns with the shaft receiving aperture. The housing subassembly may be manufactured from the same or different materials and manufactured by the same or different method as the swivel support member. Moreover, in one embodiment of the present teachings, the swivel support member and housing subassembly are manufactured as a single component.

In one embodiment of the present teaching, the housing subassembly includes one or more bearings (e.g., sleeve bearing 444 of FIG. 4) or and housing cap (e.g., housing cap 440 of FIG. 4), which has defined therein one or more fastening apertures (e.g., securing apertures 446 of FIG. 4). One or more of the bearing is positioned between the housing cap and the base portion of the swivel support member and at least a portion of each of the bearings aligns with the central aperture. A securing fastener (e.g., securing fastener 447 of FIG. 4) is disposed through each fastening aperture and engages with a fastening receiver (e.g., fastener receivers 436 of FIG. 4) to secure the housing subassembly to the swivel support member.

Next, a step 606 includes engaging at least a portion of a shaft (e.g., shaft 216 of FIG. 2) through the central aperture and the shaft receiving aperture.

Following step 606, a step 608 is performed. Step 608 includes adjusting a position of the shaft along a collective length spanned by the central aperture and the shaft receiving aperture so that the shaft terminates at a panel fitting end that engages, in a swiveling manner, with a panel. In this assembled configuration, the panel fitting end swivels with respect to the panel or the panel swivels with respect to the panel fitting end. Moreover, at least one securing ring contacts the housing subassembly, a bearing, and/or the swivel support member.

In on embodiment of the present teachings, the method of assembling the panel swivel further includes a step of securing one or more securing rings (e.g., one or more securing rings 450 of FIG. 4) or o-rings to the shaft. Each of the securing rings is disposed within a securing ring groove that is defined around a circumference of the shaft. In step 606, when at least a portion of the shaft engages through the central aperture, at least one of the securing rings contacts an inner sidewall of the housing subassembly and/or one or more bearing. Moreover, step 608 includes adjusting a position of the securing ring within the housing subassembly, one or more bearings, and/or the swivel support member.

In a preferred implementation of the present teachings, the method of assembling the panel swivel further includes a step of securing three or more securing rings to the shaft to form at least a first securing ring grouping and a second securing ring grouping. As discussed above, the first securing ring grouping creates a first predefined shaft position and the second securing ring grouping creates a second predefined shaft position. Step 608, in this implementation of the present teachings, includes adjusting the shaft from the first predefined shaft position to the second predefined shaft position or adjusting the shaft from the second predefined shaft position to the first predefined shaft position.

In one embodiment of the present teachings, the securing step may further include a first step of positioning one or more bearings between the base portion and a housing cap. In this configuration, at least a portion of each of the bearings is aligned with the central aperture and is designed to engage a portion of the shaft that passes through the central aperture. A second step includes coupling the housing cap with the base portion by passing one or more securing fasteners (e.g., securing fasteners 447 of FIG. 4) through securing apertures (e.g., securing apertures 446 of FIG. 4) and securing the securing fasteners to one or more fastener receivers (e.g., fastener receivers 426 of FIG. 4) on the base portion. Each of the fastener receivers is aligned with the securing apertures of the housing cap and designed to receive securing fasteners.

The present arrangements and teachings offer numerous advantages over conventional designs. For example, the present arrangements are easily implemented with a new panel installation (e.g., new door design installations) or easily replace existing conventional panel swivels that are expensive. As another example, the reduced weight (with the absence of discrete enclosure features or components) and that absence of the continuous maintenance requirement, make the present designs desirable over their conventional counterparts. As yet another example, the present arrangements use fewer components, have lower manufacturing costs, and takes less time to manufacture and assemble over their conventional counterparts.

Although illustrative embodiments of the present teachings and arrangements are shown and described in terms of solar modules, other modifications, changes, and substitutions are intended. Accordingly, it is appropriate that the disclosure be construed broadly and in a manner consistent with the scope of the disclosure, as set forth in the following claims.

What is claimed is:

1. A panel swivel comprising:

a swivel support member including:

a base portion including a first terminating end, a second terminating end, and having defined therein a shaft receiving aperture;

a raised surface extending from said first terminating end of said base portion and configured to contact a top support structure, wherein said raised surface has defined therein raised surface apertures that allow fasteners to pass through said raised surface and that are configured to have fasteners pass through said top support structure such that said raised surface attaches to said top support structure; and a securing edge extending from said second terminating end of said base portion and configured to contact a side support structure, wherein said securing edge has defined therein securing edge apertures that allow securing fasteners to pass through said securing edge and that are configured to have securing fasteners pass through said side support structure such that said securing edge attaches to said side support structure;

a housing subassembly extending an elevated distance above said base portion and being located an extending distance away from said raised surface apertures, wherein said housing subassembly has defined therein a central aperture aligned with said shaft receiving aperture;

a shaft extending a shaft length, a portion of which passes through said central aperture and said shaft receiving aperture, and said shaft terminates at a panel fitting end that is configured to engage, in a swiveling manner, with a panel such that said panel fitting end swivels with respect to said panel or said panel swivels with respect to said panel fitting end; and wherein said elevated distance ranges between 0.1 inches and 1.5 inches, wherein said extending distance is a distance between a center point of said raised surface apertures to a center point of said central aperture and ranges between 2 inches and 2.5 inches, and wherein said shaft length is a length that ranges between 1.25 inches and 3 inches.

2. The panel swivel of claim 1, wherein said raised surface apertures comprise a first raised surface aperture and a second raised surface aperture and a distance between a center point of said first raised surface aperture and a center point of said second raised surface aperture ranges between 1.5 inches and 1.8 inches.

3. The panel swivel of claim 1, wherein said securing edge apertures comprise a first securing edge aperture and a second securing edge aperture and a distance between a center point of said first securing edge aperture and a center point of said second securing edge aperture ranges between 1.5 inches and 1.8 inches.

4. The panel swivel of claim 1, further comprising one or more bearings disposed within said housing subassembly and at least a portion of each of said bearings is aligned with said central aperture and engages said portion of said shaft that passes through said central aperture.

5. The panel swivel of claim 1, wherein said housing subassembly comprises one or more bearings and at least a portion of each of said bearings is aligned with said central aperture and engages said portion of said shaft that passes through said central aperture.

6. The panel swivel of claim 5, wherein said one of one or more of said bearings is one or more sleeve bearings including inner sidewalls that substantially circumferentially extend to define therewithin said central aperture and an outside diameter of said shaft contacts said inner diameter of said sleeve bearings.

7. The panel swivel of claim 1, further comprising a housing cap comprising part of said housing subassembly and having defined therein securing apertures that are configured to allow securing fasteners to pass therethrough and said base portion to facilitate coupling of said housing subassembly with said base portion.

8. The panel swivel of claim 7, wherein said base portion includes one or more fastener receivers, each of which are aligned with said securing apertures of said housing cap and configured to receive securing fasteners.

9. The panel swivel of claim 1, further comprising one or more o-rings, each of which is disposed within an o-ring groove that is defined around a circumference of said shaft, and wherein, when at least said portion of said shaft passes through said shaft receiving aperture, one or more of said o-rings contacts said shaft receiving aperture.

10. The panel swivel of claim 1, wherein said raised surface extends a raising distance above said base portion, said raising distance ranges between 0.06 inches and 2 inches.

11. The panel swivel of claim 1, wherein said swivel support member is made of at least one material selected from the group consisting of sheet metal, plastic, wood, bamboo, fiberboard, and fiberglass.

12. The panel swivel of claim 1, wherein said housing subassembly is disposed on an area extending between said raised surface and said securing edge and wherein said area is not enclosed.

13. The panel swivel of claim 12, wherein said area does not include any structure disposed thereon except said housing subassembly.

* * * * *